US005836400A

United States Patent [19]

Tupper et al.

[11] Patent Number: 5,836,400

[45] Date of Patent: Nov. 17, 1998

[54] THREE SPEED CIRCUIT FOR HYDRAULIC TOOL

[76] Inventors: Myron D. Tupper, 12550 SE. 242nd Ave., Boring, Oreg. 97090; William Gallentine, 615 Country Club Rd., Hood River, Oreg. 97031

[21] Appl. No.: 972,767

[22] Filed: Nov. 18, 1997

[51] Int. Cl.[6] ..... B25F 5/00; F15B 15/18

[52] U.S. Cl. ..... 173/11; 173/193; 173/208; 91/415; 91/519

[58] Field of Search ..... 173/2, 4, 11, 13, 173/206, 207, 208, 193, 195, 114, 200, 201, 135, 138, 212, 159; 91/519, 419; 92/6 R; 72/453.16, 453.17

[56] References Cited

U.S. PATENT DOCUMENTS

| | | | |
|---|---|---|---|
| 2,704,087 | 3/1955 | Lindsay . | |
| 2,734,723 | 2/1956 | Larcen | 173/195 |
| 3,320,861 | 5/1967 | Johnson et al. . | |
| 3,587,755 | 6/1971 | Slusher | 173/159 |
| 4,206,603 | 6/1980 | Mekler . | |
| 4,246,973 | 1/1981 | Mayer | 173/11 |
| 4,263,801 | 4/1981 | Gregory . | |
| 4,356,871 | 11/1982 | Fujikawa | 173/11 |
| 4,514,796 | 4/1985 | Saulters et al. | 173/193 |
| 4,947,672 | 8/1990 | Pecora et al. . | |
| 4,957,021 | 9/1990 | Helton . | |
| 5,361,680 | 11/1994 | Matsui . | |
| 5,477,932 | 12/1995 | Asakura et al. . | |

*Primary Examiner*—Scott A. Smith
*Attorney, Agent, or Firm*—Terrance L. Siemens

[57] ABSTRACT

A hydraulic tool having a ram or other working element propelled by pressurized fluid. The tool has a lever which is squeezed to develop fluid force in a pump. The fluid circuitry automatically operates the ram selectively at any one of three operating speeds and hence at three different magnitudes of force relative to the input speed of the lever as it is squeezed. The circuitry includes a principal supply subcircuit in which fluid flows directly from the pump to the ram, thereby establishing a normal speed mode of operation. A high speed subcircuit and a low speed subcircuit each operated by respective pressure responsive valves direct fluid ejected as the ram piston and pump piston advance to the respective rear sides of the ram piston and pump piston. This has the effect of accelerating the ram and operating at reduced force, thereby establishing a high speed mode of operation when resistance against the ram is minimal, and of decelerating the pump piston and operating at greater force, thereby establishing a low speed mode of operation when resistance is relatively high. In a preferred embodiment, the hydraulic tool includes a handle enabling grasping in pistol grip fashion and enabling ready squeezing of the lever.

11 Claims, 4 Drawing Sheets

THREE SPEED CIRCUIT FOR HYDRAULIC TOOL

BACKGROUND OF THE INVENTION

1. Field of the Invention

The present invention relates to hydraulically operated tools of the type having working elements such as jaws which close over a work piece. More particularly, the invention relates to a hydraulic tool having a hydraulic circuit arranged to provide three speeds of closure of jaws or corresponding tool movement at one input speed.

The field of endeavor most likely to benefit from this invention is the construction industry in that the device is specifically intended for use in creating effective hand tools which are often used in the building trades. However, the general fields of mechanical assembly and automotive repair could also benefit from the apparatus herein disclosed. For example, any process requiring crimping, bending, punching, cutting, pressing, etc. could significantly benefit from the performance characteristics of the instant hydraulic tool. The application of the instant hydraulic invention to a manual punch provides an ideal example of use in manufacturing and general repairs. Thus it can be seen that the potential fields of use for this invention are myriad and the particular preferred embodiment described herein is in no way meant to limit the use of the invention to the particular field chosen for exposition of the details of the invention.

2. Description of the Prior Art

Gripping, clamping, pressing, and punching tools frequently employ hydraulic circuits for actuating solid moving parts of the tool. In hydraulically operated tools, it is quite practical to provide increase in force which can be applied to the tool. Overpressure relief valves and other valves are readily incorporated into hydraulic circuitry. Magnification of force is readily accomplished by varying respective areas of driving and driven components, such as a pump plunger and a driven piston, subjected to fluid pressure.

However, when a tool designed to develop great farce is first moved into operative engagement with a work piece, moving the jaws or equivalent structure into contact with the work piece is wasteful if performed at full power and tedious if performed at the normal speed of operation. This situation prevails whenever the tool is designed to provide only one mode of operation, that being intended for applying great force after the point of contact with the work piece. In initially setting up the work, it is easier to pressurize and utilize a relatively great volume of fluid to move the tool quickly to first engage the work.

Hydraulic hand tools are illustrated in U.S. Pat. No. 4,263,801, issued to Jack T. Gregory on Apr. 28, 1981, 4,947,672, issued to Gennaro L. Pecora et al. on Aug. 14, 1990, and 4,957,021, issued to Darion L. Helton on Sept. 18, 1990. Automatic transition in a valving scheme is illustrated in U.S. Pat. No. 2,704,087, issued to Rolland S. Lindsay on Mar. 15, 1955. However, these patents fail to show circuitry acting on a single pressure receiving piston, resulting in three distinct operating speeds, as provided in the present invention.

U.S. Pat. No. 3,320,861, issued to Harry J. Johnson et al. on May 23, 1967, 4,206,603, issued to Dan Mekler on Jun. 10, 1980, 5,361,680, issued to Akio Matsui on Nov. 8, 1990, and 5,477,932, issued to Shigeki Asakura et al. on Dec. 26, 1995, illustrate tools designed to operate at variable force for positioning and operating. However, these examples Fail to show circuitry acting on a single pressure receiving piston, resulting in three distinct operating speeds, as provided in the present invention.

None of the above inventions and patents, taken either singly or in combination, is seen to describe the instant invention as claimed.

SUMMARY OF THE INVENTION

The present invention sets forth a structure having novel hydraulic circuitry for propelling a ram at three different speeds, and hence at three different magnitudes of force, from a constant input force and input speed. The structure includes a piston pump for developing fluid pressure and a ram having a ram piston moved by fluid pressure developed within the pump. Appropriate valves and conduits are incorporated into the circuitry so that the ram piston operates at any one of three speeds relative to that of the pump piston. Circuitry is further arranged to provide ordinary functions such as overpressure relief and returning pistons to their original positions in preparation for new strokes. The pump, ram, valves, and conduits are all individually of generally conventional construction. Speed changes are accomplished automatically, responsive to resistance encountered by the ram.

The novel apparatus is preferably incorporated into both hand tools and powered tools such as those suitable for crimping, bending, punching, cutting, pressing, gripping, and similar operations requiring bringing force or pressure to bear on a work piece. Jaws or corresponding working elements of such tools are typically first closed over the work piece, then force is applied to carry out the intended function.

Varying levels of resistance are associated with different phases of the operation. The lowest possible degree of resistance occurs prior to the tool engaging a work piece. Under these conditions, the jaws or other working elements of the tool advance under maximal speed relative to that of the pump piston. When the working elements encounter the work piece so that additional but not extreme resistance is encountered, internal valving acts automatically to modify the circuitry so that the working elements gain leverage relative to operation prior to engagement of the work piece. The gain in force occurs simultaneously with a reduction in speed of motion of the working elements relative to the pump piston. When a very high or extreme level of resistance is encountered, a further automatic modification to valving operation is effected. The further modification further reduces relative speed while increasing force. Thus three relative speeds are provided.

Thresholds dictating which speed prevails are predetermined. Pressure responsive valves, such as spring loaded check valves, responsive to specific, predetermined levels of pressure affect circuitry to effect fluid transfer schemes transferring pressurized fluid from one side of a piston to the other side of the same piston, thereby modifying net effective area acted upon by the pressurized fluid. Hence operation is automatic.

The invention is particularly advantageously applied to hand tools. In the high speed, low force mode, progress in closing the tool over the work piece is rapidly achieved. This prevents a worker from being required to repeat squeezing actions tediously, slowly, and repetitiously merely to engage the work piece. As the tool engages the work piece, it then acts in either of two additional modes of operation. If resistance is minimal, then a high speed working mode is effected. Tool speed in this mode is reduced from that of the initial mode wherein the tool is closed over the work piece.

However, it is greater than a third mode which occurs automatically a severe resistance is encountered. Thus, the tool closes quite rapidly until first engaging the work piece. When performing the intended task or operation on the work piece, the speed of operation is either relatively fast, at lower force, or on the other hand is relatively slow, with greater forces Hydraulic leverage is exploited such that force and speed are inversely proportional for the three speeds. Thus the work is expeditiously accomplished by the novel tool, with no manual adjustments demanded of the user.

The tool employs a reciprocating piston pump which develops pressure when the piston is moved in one direction, and recharges when the piston is moved oppositely. This type of action cooperates with a lever which may be readily squeezed by hand. The lever is preferably arranged generally parallel and proximate to the tool handle, thereby enabling conventional pistol grip operation Accordingly, it is a principal object of the invention to provide a hydraulic tool which offers three speeds of output motion relative to one speed of input motion.

Another object of the invention is that transition of the three speeds be automatic, not requiring a specific adjustment by the user.

It is a further object of the invention that output force vary inversely with output speed.

An additional object of the invention is that the invention be suitable for manual, pistol grip operation.

Still another object of the invention is that the invention utilize conventional components.

An additional object of the invention is to enable overpressure relief and resetting of the pistons to their original positions in preparation for new strokes.

It is again an object of the invention that automatic transition between speeds be accomplished automatically by pressure responsive valves.

Yet another object of the invention is that the various speeds be effected by fluid transfer schemes transferring fluid from one side of a piston to the other side, thereby modifying net effective area acted on by the pressurized fluid.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
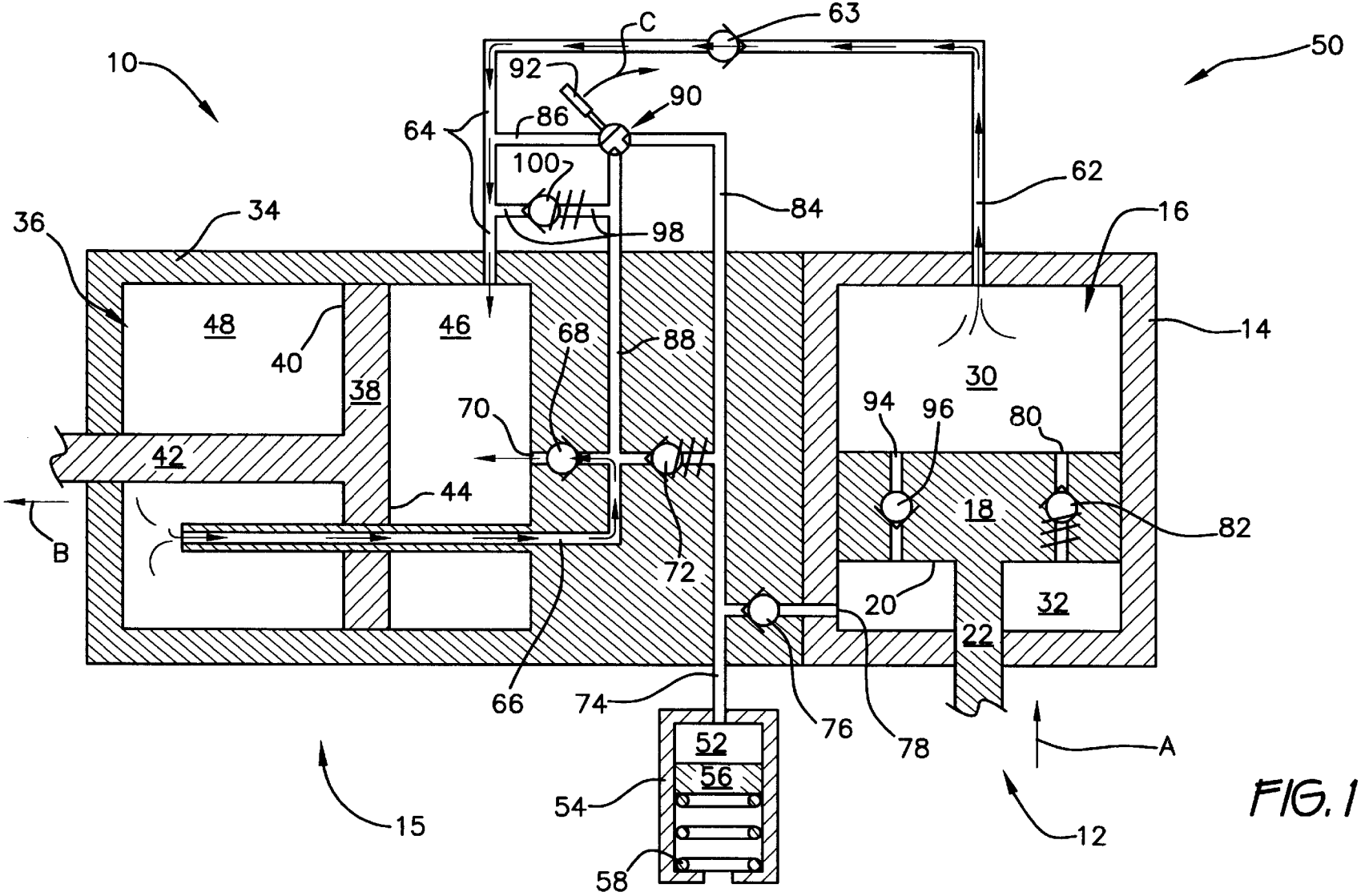
FIG. 1 is a schematic diagram of the invention, showing flow occurring in a high speed, low force mode of operation.

The present invention is schematically shown in FIG. 1 as hydraulic device 10, which includes a pump 12 which receives a mechanical input and a ram 15 providing a mechanical output. Pump 12 has a housing 14 including a pump bore 16 and a pump piston 18 disposed to move linearly within pump bore 16. Piston 18 has a rear face 20, an input shaft 22 projecting from pump rear face 20, and a front face 24. Piston 18 occupies pump bore 16, thereby dividing bore 16 into two chambers 30, 32. A pumping chamber 30 exposed to front face 24 is formed on one side of piston 18, and a storage chamber or rear chamber 32 exposed to rear face 20 of piston 18 is formed on the other side of piston 18. Ram 15 has a ram housing 34 forming a ram bore 36 and a ram piston 38 disposed to move within ram bore 36. Ram piston 38 has a front face 40, an output shaft 42 projecting from front face 40, and a rear face 44. Piston 38 occupies ram bore 36, thereby dividing bore 36 into two chambers 46, 48. A drive chamber 46 exposed to rear face 44 of piston 38 is formed on one side of piston 38, and a front chamber 48 exposed to front face 40 of ram piston 38 is formed on the other side of piston 38.

Fluid circuitry 50 communicates between pump bore 16 and ram bore 36 such that fluid pressure developed within pump 12 is imposed on ram piston 38. Pressure is developed when piston 18 is urged in the direction of arrow A. Circuitry 50 conducts fluid under pressure to act on ram piston 38, thereby urging piston 38 in the direction indicated by arrow B. As depicted throughout the drawing figures, the front sides of pistons 18, 38 will be the leading faces 24, 40, respectively, as pistons 18, 38 move in the directions of respective arrows A, B. Force and motion imposed on input shaft 22 of pump 12 are the mechanical input, and force and motion exerted by output shaft 42 of ram 15 are the mechanical output of hydraulic device 10. Circuitry 50 includes conduits and valves enabling hydraulic device 10 to operate as described herein.

Operation includes three modes of normal operation, or three speeds. Obviously, piston 18 may be moved at three or more speeds, and piston 38 would consequently move at three or more corresponding speeds However, circuitry 50 is disposed to move ram piston 38 selectively at three speeds relative to each one possible speed of pump piston 18. The three modes of normal operation refer to movement of ram output shaft 42 in the direction of arrow B. Circuitry 50 also enables support functions ordinarily provided for hydraulic tools, such as initially filling of pump 12, recharging pump 12 for subsequent operations, and relieving overpressure conditions. The various valves, to be described hereinafter, are disposed to effect transition from one ram speed to another ram speed automatically.

In operation, volumes of chambers 30, 32, 46, 48 vary such that an externally located storage volume assists operation by accommodating fluctuations in volume. A fluid storage reservoir 52 communicating with circuitry 50 is provided to answer this need. Reservoir 52 comprises a reservoir housing 54 occupied and sealed by a movable reservoir piston 56. A strong spring 58 braced against housing 54 constantly urges piston 56 to propel fluid into circuitry 50. Reservoir 52 accepts excess fluid ejected from pump bore 16 and from ram bore 36.

The first mode of operation is a high speed, low force mode in which jaws (not shown) or other working elements of the tool associated with hydraulic tool 10 are moved into engagement with a work piece. There is little need for force beyond moving the working elements to the point of contact with the work piece. Hence force is sacrificed for increase speed of closure of the jaws during positioning of the tool on the work piece. In the next modes of operation, the intended function of the tool is carried out.

The high speed mode for closing the working elements over a work piece will now be described, with, fluid flow being indicated by arrows. When force is applied via input shaft 22 to piston 18 in the direction of arrow A, fluid contained in pumping chamber 30 is pressurized, and flows through a primary supply subcircuit to enter drive chamber 46, thereby urging ram piston 38 in the forward direction. The primary supply subcircuit comprises conduits 62 and 64 communicating between chambers 30 and 46 and a unidirectional check valve 63 which opposes backflow from chamber 46 to chamber 30, valve 63 being interposed between conduits 62 and 64.

When no resistance is imposed upon output shaft 42, fluid is ejected from chamber 48 through conduit 66 past unidirectional high speed control valve 68 and through conduit 70 into chamber 46. This is possible since the net effective area of rear face 44 of piston 38 exceeds that of front face 40 owing to the presence of output shaft 42 reducing effective area of front face 40. Therefore, a greater net force is exerted on ram piston 38 in the direction of arrow B, and fluid is ejected from chamber 48 to chamber 46 even when the static pressure in chamber 48 is substantially equal to that in chamber 46 Thus a greater volume of fluid than can be generated in chamber 30 enters chamber 46. This occurrence increases speed of piston 38 relative to that which would result if chamber 30 were the only source of fluid entering chamber 46. This increased speed gives rise to the aforementioned high speed mode. The high speed subcircuit may be regarded as comprising the subcircuit generated by conduits 66 and 70 and high speed control valve 68. Control valve 68 is a check valve which additionally opposes escape of fluid from driving chamber 46 back into circuitry 50 through conduit 70.

Turning now to FIG. 20 when ram output shaft 42 encounters a predetermined degree of resistance which would correspond to engagement of the workpiece, an intermediate speed mode prevails. The fluid no longer passes valve 68 due to increase of pressure in chamber 46. Fluid ejected from chamber 48 now passes through a pressure responsive valve 72 and enters a conduit 74, from which it opens check valve 76 to fill chamber 32 from conduit 78, and also enters reservoir 52 through conduit 74. The only source of fluid entering chamber 46 is that ejected under pressure from pumping chamber 30. Thus the intermediate speed mode utilizes only the primary supply subcircuit to fill working chamber 46. In this mode, only fluid ejected from pumping chamber 30 is used to fill working chamber 46.

Figure 3:
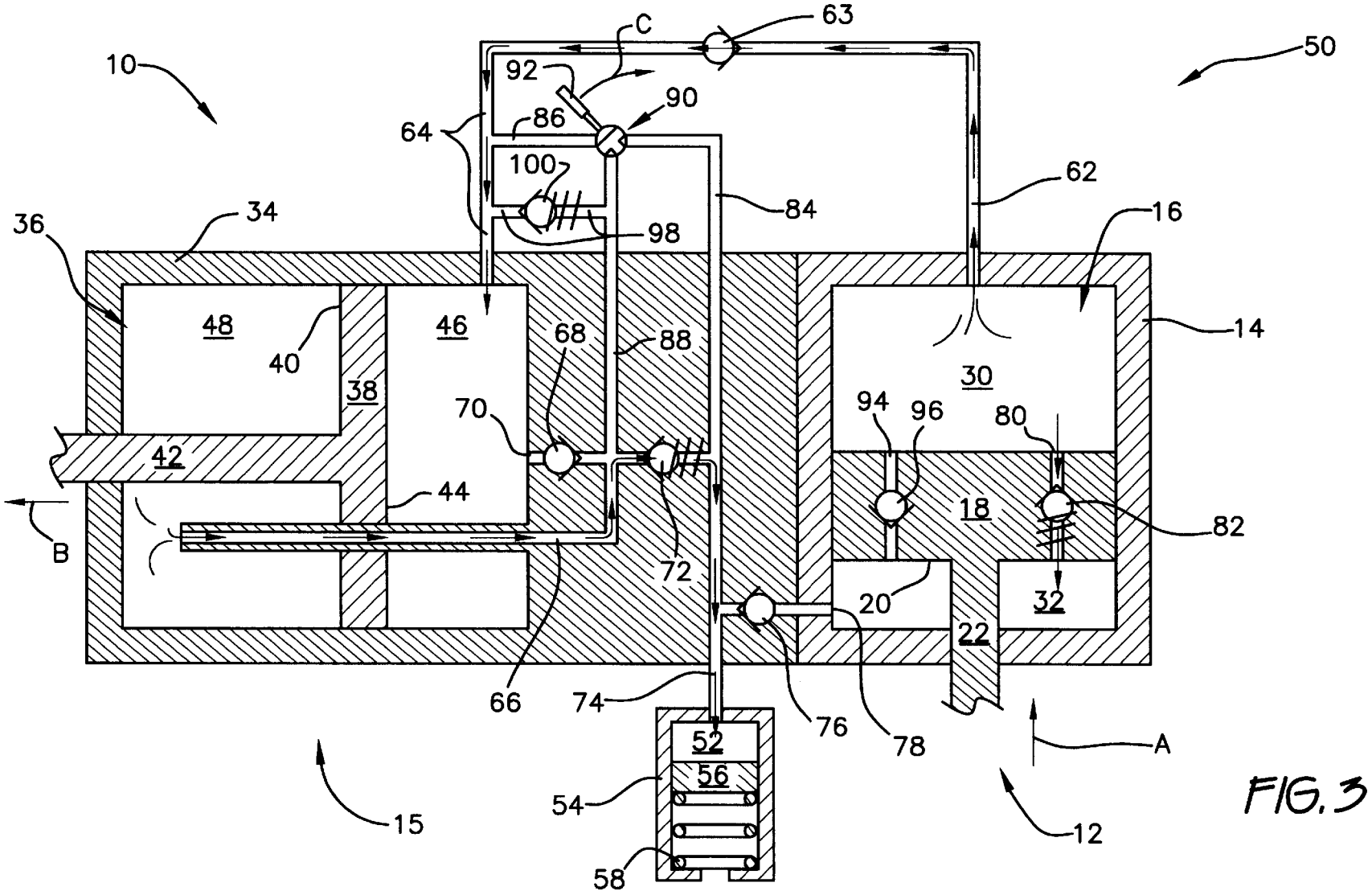
FIG. 3 is a schematic diagram similar to FIG. 1, but showing flow occurring in a low speed, high force mode of operation.

When a still greater degree of resistance is encountered requiring added force over that available in the intermediate speed mode, a low speed, high force mode prevails. In the low speed mode, shown in FIG. 3 wherein fluid flow is indicated by arrows, a low speed subcircuit acts simultaneously with the primary supply subcircuit. The low speed subcircuit comprises conduit 80 and a pressure responsive unidirectional low speed control valve 82. When increased pressure developed in chamber 30 opens control valve 82, some fluid ejected from chamber 30 flows into chamber 32. This action reduces the net effective area of piston 18, and thus causes piston 18 to advance at a greater speed relative to the speed of piston 38 now absent flow through conduit 80. Thus it will be seen that for a given force applied to shaft 22 in this low speed, high force mode, that the pressure generated in chamber 30 now increases in proportion to the decrease in the net effective area of piston 18. This increased pressure is translated to ram piston 38 throughout the primary supply circuit, which in turn delivers an increased force to output shaft 42.

In summary, ram piston 38 moves at increased speed and commensurately reduced force relative to pump piston 18 when fluid is routed from the front of ram piston 38 to the rear thereof. Similarly, ram piston 38 moves at reduced speed and commensurately increased force relative to pump piston 18 when fluid is routed from the front of pump piston 18 to the rear thereof. When neither of these front-to-back flows occurs, an intermediate speed, intermediate force mode prevails. High speed control valve 68, working in conjunction with spring loaded check valve 72, operably controls the high speed subcircuit automatically, responsive to high pressure exceeding a first predetermined threshold pressure developed in working chamber 46. Low speed control valve 82 operably controls the low speed subcircuit automatically, responsive to pressure developed in chamber 30 exceeding a second predetermined threshold pressure.

Circuitry 50 also enables support functions such as releasing fluid after the working stroke is complete, in preparation for a subsequent stroke, and overpressure relief. A release subcircuit includes conduits 84, 86, and 88, and valve 90. When valve 90 is rotated from the closed position illustrated into an open position, conduits internal to valve 90 align with and communicate among conduits 84, 86, and 88. Valve 90 is manual, being operated by a suitable handle represented at 92. Direction of rotation opening valve 90 is indicated by arrow C. When valve 90 is open, fluid is free to flow out from drive chamber 46, through conduit 64 to conduit 86, through valve 90, and into conduits 84 and 88. Fluid passing through conduit 88 returns to chamber 48 through conduit 66, and that passing through conduit 84 enters reservoir 52, and, if conditions allow, enters chamber 32 of pump 12.

A conduit 94 controlled by a check valve 96 enables fluid from rear chamber 32 of pump 12 to pass into chamber 30 during resetting of device 10 in preparation of a new stroke. Check valve 96 prevents backflow which would defeat normal operation while enabling resetting or refilling to proceed when pump piston 18 is moved in a direction opposite that of arrow A.

An overpressure relief subcircuit is provided to limit maximum force exerted by shaft 42 and for general safety. This is accomplished by relief of pressure in chamber 46. A relief subcircuit is established by conduit 98, which includes a unidirectional pressure responsive valve 100. When a predetermined high pressure is generated in chamber 46, valve 100 opens, thereby allowing fluid to escape to conduit 88 and open valve 72 to pass fluid to reservoir 52 of circuitry 50. Likewise, as the pressure in chamber 46 is relieved, valve 63 will automatically open, relieving pressure in chamber 30.

Figure 4:
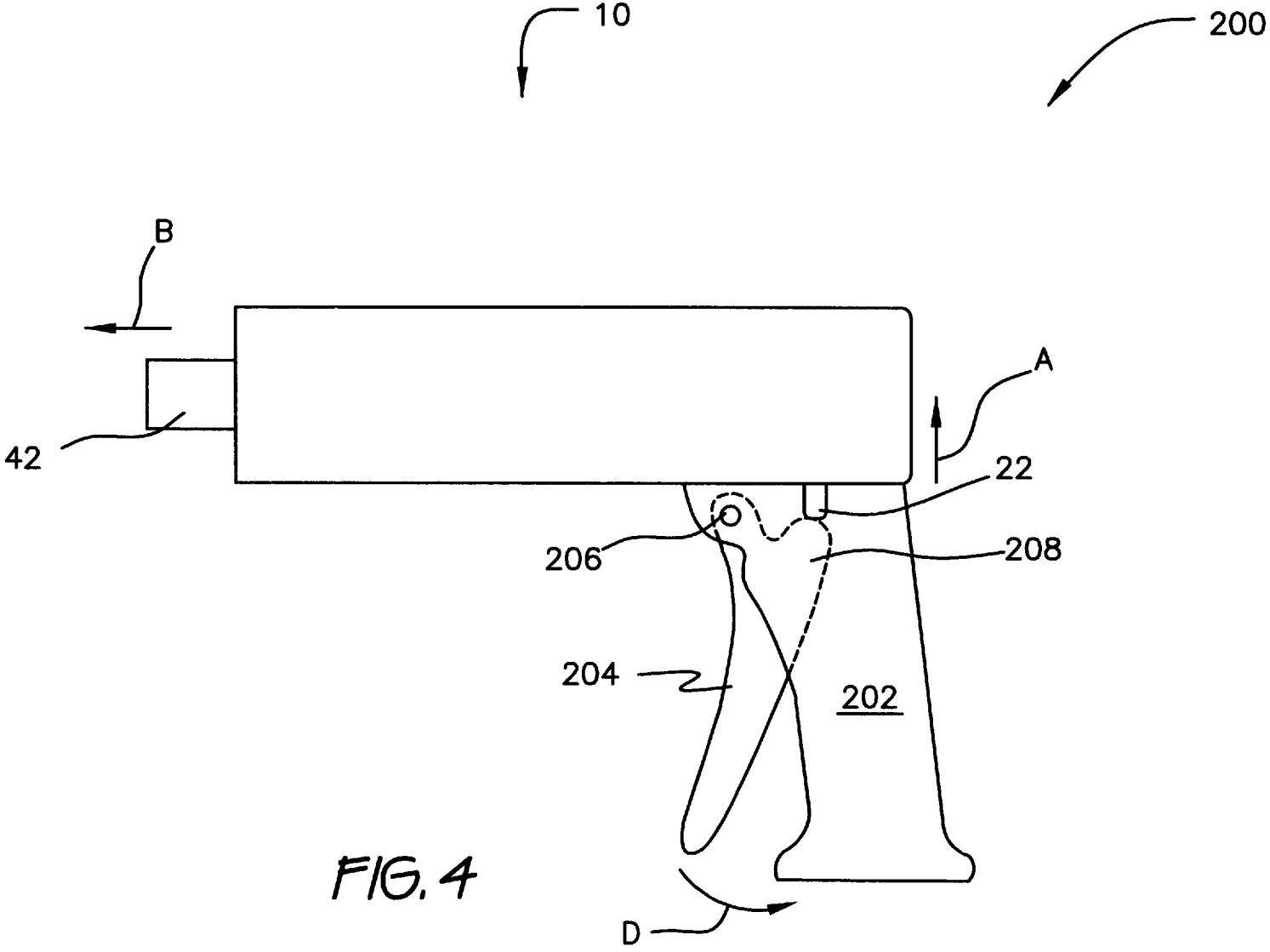
FIG. 4 is a side elevational view of a preferred embodiment of the invention, wherein the circuitry of FIGS. 1–3 is adapted to a hand tool.

A preferred embodiment of a hand tool 200 utilizing hydraulic device 10 is shown in FIG. 4. Tool 200 is arranged to be grasped in pistol grip fashion by a suitable ergonomically configured handle 202 which is rigidly fixed to device 10. A lever 204 is provided with attachment elements pivotally engaging handle 202 and supporting lever 204 on handle 202, such as by journalling lever 204 at a pin 206 near the juncture of handle 204 and the structure of device 10. A projection 208 fixed to lever 204 directly acts on and drives input shaft 22 when lever 204 is rotated in the direction of arrow D.

Figure 2:
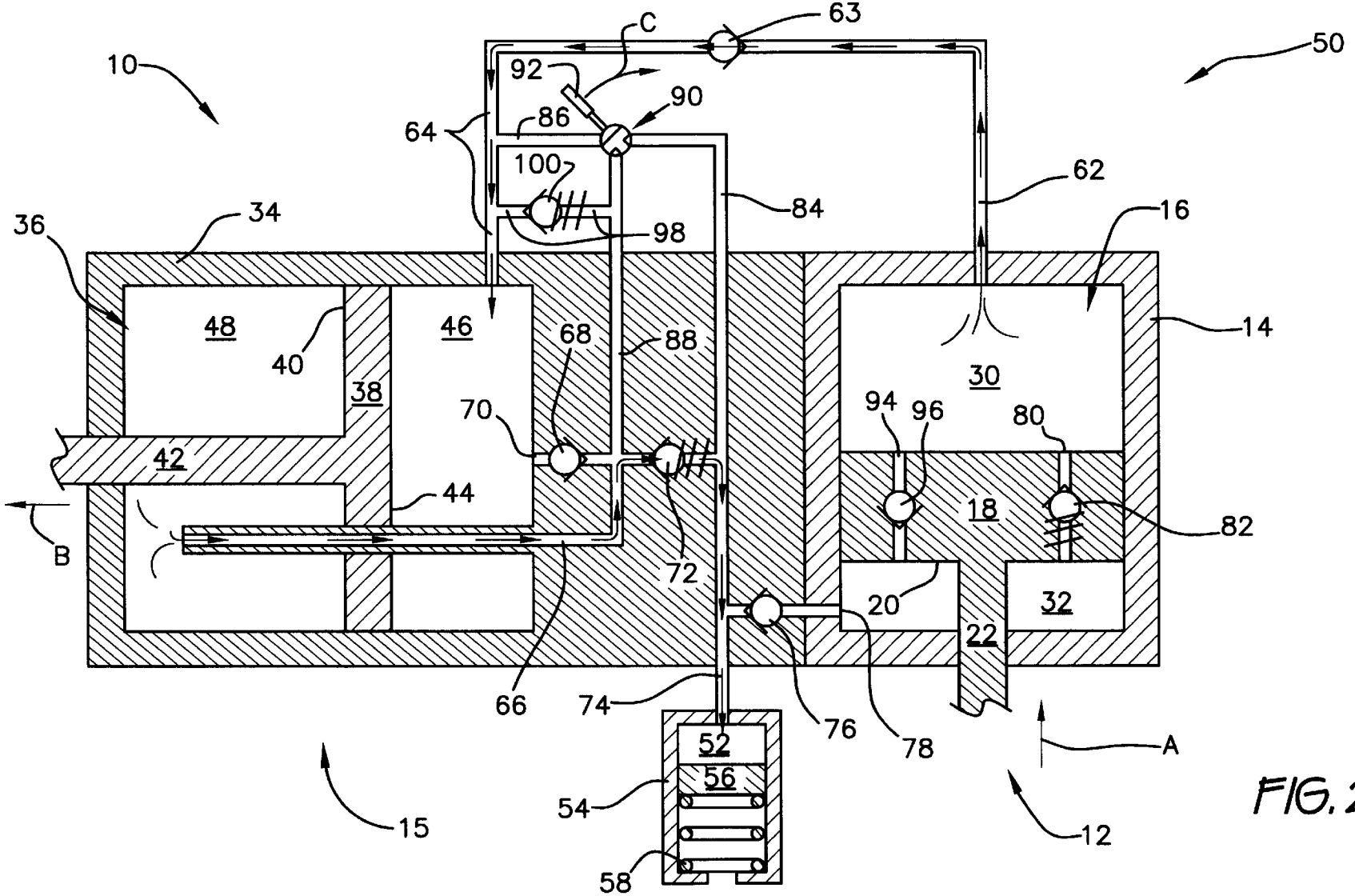
FIG. 2 is a schematic diagram similar to FIG. 1 but showing flow occurring in an intermediate speed, intermediate force mode of operation.

It is contemplated that most hand tools improved by incorporation of device 10 will be arranged so that the handle is generally perpendicularly oriented with respect to direction of action of output shaft 42, this being indicated by arrow B. For this purpose, device 10 is configured substantially in the manner depicted in FIGS. 1–3, with pump bore 16 disposed adjacent to handle 202, and with ram bore 36 disposed at an oblique angle to and adjacent to pump bore 16. This enables tool 200 to be wielded such that lever 204 is operated in pistol grip fashion, with output shaft 42 moving forwardly relative to the arm of a user when the hand of the user grasps handle 202 and squeezes lever 204.

The invention is subject to variations and modifications which may be introduced without departing from the inventive concept. For example, device 10 could be adapted to tools (not shown) other than hand tools. Individual conduits of circuitry 50 may be disposed externally to or internally within housings 14 and 34, as described in the related patent applications cited above. The output shaft 42 may be remotely located relative to handle 202 and lever 204, and may in some cases not be rigidly fixed thereto. The valves may be modified from the arrangements described above. Illustratively, where it is desirable to defeat automatic operation in favor of manual operation, manual valves may be substituted for the appropriate pressure responsive valves. Actuation of input shaft 22 of pump 12 may be indirectly accomplished by intervening linkage elements (not shown), if desired.

It is co be understood that the present invention is not limited to the embodiments described above, but encompasses any and all embodiments within the scope of the following claims.

We claim:

1. A hydraulic device having a mechanical input and a mechanical output, comprising:

a pump having a housing including a pump bore and a pump piston disposed to move linearly within said pump bore and to develop pressure on fluid occupying said pump;

a ram having a ram housing including a ram bore and a ram piston disposed to move within said ram bore; and fluid circuitry communicating between said pump bore and said ram bore such that fluid pressure developed within said pump is imposed on said ram piston, said fluid circuitry disposed to move said ram piston selectively at three speeds with corresponding magnitudes of force relative to a single speed of said pump piston.

2. The hydraulic device according to claim 1, further comprising a handle fixed to said housing and a lever having attachment elements pivotally engaging said handle and supporting said lever on said handle, said lever having structure drivingly connecting said lever to said pump piston.

3. The hydraulic device according to claim 1, said fluid circuitry including valves disposed to effect transition from one said speed to another said speed automatically.

4. The hydraulic device according to claim 1, said pump piston having a rear face, an input shaft projecting from said pump rear face, and a front face, said pump bore having a pumping chamber exposed to said front face of said pump piston and a rear chamber exposed to said rear face of said pump piston, and said ram piston having a front face, an output shaft projecting from said front face, and a rear face, said ram bore having a front chamber exposed to said front face of said ram piston and a drive chamber exposed to said rear face of said ram piston, said fluid circuitry including a primary supply subcircuit conducting fluid from said pumping chamber of said pump to said drive chamber of said ram and including a check valve opposing backflow from said drive chamber to said pumping chamber, a low speed subcircuit disposed to conduct fluid under pressure from said pumping chamber of said pump to said rear chamber of said pump, said low speed subcircuit having a low speed subcircuit control valve operably controlling said low speed subcircuit, and a high speed subcircuit disposed to conduct fluid under pressure from said front chamber of said ram to said drive chamber of said ram, said high speed subcircuit having a high speed subcircuit control valve operably controlling said high speed subcircuit.

5. The hydraulic device according to claim 4, said high speed subcircuit control valve being a pressure responsive valve disposed to open said high speed subcircuit responsive to pressures prevailing within said front chamber of said ram exceeding a first predetermined threshold pressure and to close said high speed subcircuit responsive to pressures below said first predetermined threshold pressure.

6. The hydraulic device according to claim 4, said low speed subcircuit control valve being a pressure responsive valve disposed to open said low speed subcircuit responsive to pressures prevailing within said pumping chamber exceeding a second predetermined threshold pressure and to close said low speed subcircuit responsive to pressures below said second predetermined threshold pressure.

7. The hydraulic device according to claim 4, further comprising a handle fixed to said housing and a lever having attachment elements pivotally engaging said handle and supporting said lever on said handle, said lever having a projection directly acting on and driving said input shaft of said pump piston, said pump bore disposed adjacent to said handle, and said ram bore disposed at an oblique angle to and adjacent to said pump bore, whereby said lever is operated in pistol grip fashion and said output shaft moves forwardly relative to the arm of a user when the hand of the user grasps said handle and squeezes said lever.

8. The hydraulic device according to claim 1, said fluid circuitry comprising an overpressure relief subcircuit enabling fluid to pass from said pumping chamber exclusively into said rear chamber of said pump.

9. The hydraulic device according to claim 1, said comprising a fluid storage reservoir disposed in communication with said fluid circuitry for accepting excess fluid ejected from said pump bore and from said ram bore.

10. A hydraulic device having a mechanical input and a mechanical output, comprising:

a pump having a housing including a pump bore and a pump piston disposed to move linearly within said pump bore and to develop pressure on fluid occupying said pump, said pump piston having a rear face, an input shaft projecting from said pump rear face, and a front face, said pump bore having a pumping chamber exposed to said front face of said pump piston and a rear chamber exposed to said rear face of said pump piston;

a ram having a ram housing including a ram bore and a ram piston disposed to move within said ram bore, said ram piston having a front face, an output shaft projecting from said front face, and a rear face, said ram bore having a front chamber exposed to said front face of said ram piston and a drive chamber exposed to said rear face of said ram piston; and fluid circuitry communicating between said pump bore and said ram bore such that fluid pressure developed within said pump is imposed on said ram piston, said fluid circuitry disposed to move said ram piston selectively at three speeds with corresponding magnitudes of force relative to a speed of said pump piston, said fluid circuitry including valves disposed to effect transition from one said speed to another said speed automatically, said fluid circuitry including a primary supply subcircuit conducting fluid from said pumping chamber of said pump to said drive chamber of said ram and including a check valve opposing backflow from said drive chamber to said pumping chamber, a low speed subcircuit disposed to conduct fluid under pressure from said pumping chamber of said pump to said rear chamber of said pump, said low speed subcircuit having a low speed subcircuit control valve operably controlling said low speed subcircuit, and a high speed subcircuit disposed to conduct fluid under pressure from said front chamber of said ram to said drive chamber of said ram, said high speed subcircuit having a high speed subcircuit control valve operably controlling said high speed subcircuit, said high speed subcircuit control valve being a pressure responsive valve disposed to open said high speed subcircuit responsive to pressures prevailing within said front chamber of said ram exceeding a first predetermined threshold pressure and to close said high speed subcircuit responsive to pressures below said first predetermined threshold pressure, and said low speed subcircuit control valve being pressure responsive valve disposed to open said low speed subcircuit responsive to pressures prevailing within said pumping chamber exceeding a second predetermined threshold pressure and to close said low speed subcircuit responsive to pressures below said second predetermined threshold pressure.

11. The hydraulic device according to claim 10, further comprising a handle fixed to said housing and a lever having attachment elements pivotally engaging said handle and supporting said lever on said handle, said lever having a projection directly acting on and driving said input shaft of said pump piston, said pump bore disposed adjacent to said handle, and said ram bore disposed at an oblique angle to and adjacent to said pump bore, whereby said lever is operated in pistol grip fashion and said output shaft moves forwardly relative to the arm of a user when the hand of the user grasps said handle and squeezes said lever.

* * * * *